United States Patent [19]

Fujimoto

[11] 4,310,151

[45] Jan. 12, 1982

[54] SHEET FEEDING APPARATUS

[75] Inventor: Sakae Fujimoto, Chofu, Japan

[73] Assignee: Ricoh Company, Ltd., Tokyo, Japan

[21] Appl. No.: 44,670

[22] Filed: Jun. 1, 1979

Related U.S. Application Data

[63] Continuation of Ser. No. 825,389, Aug. 17, 1977, abandoned.

[30] Foreign Application Priority Data

Aug. 20, 1976 [JP] Japan ..... 51/99278
Aug. 20, 1976 [JP] Japan ..... 51/99279

[51] Int. Cl.[3] ..... B65H 3/06; B65H 3/08; B65H 3/54

[52] U.S. Cl. ..... 271/11; 271/103; 271/106; 271/112; 271/118

[58] Field of Search ..... 271/112, 103, 106, 107, 271/117, 118, 93, 20, 15, 12, 13, 105, 11; 221/211, 259; 414/121, 123

[56] References Cited

U.S. PATENT DOCUMENTS 3,199,863 8/1965 Muller ..... 414/121
3,314,676 4/1967 Fromm ..... 271/106
3,465,129 9/1969 Mitchell ..... 271/11 X
3,964,740 6/1976 Lamb ..... 271/112 X

FOREIGN PATENT DOCUMENTS 678790 of 1939 Fed. Rep. of Germany .

*Primary Examiner*—Bruce H. Stoner, Jr.
*Attorney, Agent, or Firm*—Wyatt, Gerber, Shoup, Scobey & Badie

[57] ABSTRACT

A sheet feeding apparatus comprising a vertically movable vacuum plate having openings for sucking sheets individually and for allowing sheet feeding rollers to extend therethrough for translating the sucked sheets, wherein a sheet pressing portion is formed in the vacuum plate to form a space between the forward end portions of the sheets and the vacuum plate prior to the suction of the sheets. In another embodiment, instead of the sheet pressing portion, a sheet feeding roller mounted on the vacuum plate is utilized as the sheet pressing element, so that the sheets are pressed before being sucked causing the suction force to be applied to the forward end portions of the sheets.

9 Claims, 12 Drawing Figures

SHEET FEEDING APPARATUS

This is a continuation of application Ser. No. 825,389, filed Aug. 17, 1977, now abandoned.

BACKGROUND OF THE INVENTION

This invention relates to improved sheet feeding apparatus for separating sheets of material individually from a stack of such sheets placed on a sheet receptacle and translating them to a processing device, and more particularly to a sheet feeding apparatus for feeding paper sheets by air suction of each sheet.

In the systems provided with a paper feeding apparatus for separating a single sheet of paper individually from a stack of such sheets, for example, in paper feeding apparatus for feeding original documents to be transmitted, such as employed in a facsimile system, accurate separation and feeding of paper is required, and in practice, the originals to be transmitted vary in their quality, stiffness and other characteristics. Thus the conventional paper separating and feeding apparatus employing corner claws is of no use in this field.

Therefore, in the field of facsimile systems, attention has been directed to a paper feeding apparatus using air suction, which is operative by drawing the top sheet of the stack by air suction, and such apparatus has already been put into practical use. One example is shown in FIG. 1 wherein reference number 1 indicates an axial fan. The axial fan 1 has a suction port which is located at a position corresponding to opening 2*a* formed in suction box 2 disposed beneath the axial fan 1. In the suction box 2, feed roller 3 is mounted, which is connected to a drive source (not shown) for rotation in the direction of the arrow. Also in the suction box 2, vacuum plate 4, forming the bottom of the suction box 2, is pivotally supported by support shaft 5. In the vacuum plate 4, opening 4*a* is formed at a position corresponding to the feed roller 3 so as to allow the roller 3 to fit therein. Below the vacuum plate 4, sheets 6 are stacked on sheet receptacle 7, their leading ends being aligned vertically.

While the apparatus is not operated, the forward end of the vacuum plate 4 is held in contact with the top sheet as indicated by chain line 4A.

Upon a command to feed paper, the feed roller 3 begins to rotate in the direction of the arrow and at the same time the axial fan 1 is actuated to evacuate air from the suction box 2. Thus top sheet 6*a* is drawn into contact with the vacuum plate 4 at about the opening position 4*a*A. The opening 4*a* is closed by the sucked sheet 6*a*, and the vacuum plate 4 is lifted to a solid line position as it is drawn by the sucking action. At this time, the feed roller 3, rotating in the direction of the arrow, extends through the opening 4*a* and is brought into contact with the sucked sheet 6*a*, with the result that the roller translates the sheet 6*a* by friction in the direction of the arrow a.

The manner in which the sheets are brought into contact with the vacuum plate 4 by suction may also be as follows. Since the sheets 6 have their leading ends pressed down by the forward end portion of the plate 4, the top sheet 6*a* may not easily separate from sheet 6*b*, stacked immediately beneath it, when the two sheets are clinging together, and at this time, the sheet 6*b* may also be moved upwardly as shown in FIG. 2. However, particularly in a facsimile system, such an accident as a plurality of sheets being lifted and fed together must be obviated in feeding the originals to be transmitted. Also, feeding of a plurality of paper sheet causes a paper jam.

SUMMARY OF THE INVENTION

A principal object of the invention is to provide a sheet feeding apparatus using air suction, which securely separates sheets of material individually from a stack of such sheets, eliminating the above-mentioned shortcomings of the conventional paper feeding apparatus.

In one embodiment according to the invention, a sheet pressing portion is formed in a vacuum plate in a position near the forward end thereof in order to form a gap between the vacuum plate and the forward end portion of the sheets, whereby a suction force is first applied to the forward end portion of the top sheet, and also whereby gaps are formed between the forward end portions of the succeeding stacked sheets. Thus according to the invention, by the formation of the gaps, the sheets can be separated readily and securely from one another, and the feeding of a plurality of sheets is obviated.

In order to accomplish this object more securely, in another embodiment of this invention, sheet suction openings are formed in the vacuum plate in positions closer to the forward end of the vacuum plate than the sheet pressing portion, so that the application of suction force is more concentrated on the forward end portions of the sheets.

In a further embodiment of this invention, a sheet feeding roller mounted on the vacuum plate is utilized as the sheet pressing member.

An effect of the sheet suction being started at the forward end portions of the stacked sheets is that the sheets can be more readily separated from a stack of sheets when the end portions of the sheets, including the corners thereof, are sucked than when the central portions of the sheet are sucked, since air can enter more readily at the end portions of the sheets during the paper suction. Thus a smaller suction force will do when such suction is started with the forward end portion of each paper, compared with the necessary suction force when the central portions are sucked.

Therefore, a feature of the invention is that the sheets are pressed downwardly before being sucked so as to cause the suction force to be exerted on the leading ends of the sheets, whereby the sheets can be separated readily and securely from one another.

DETAILED DESCRIPTION OF THE PREFERRED EMBODIMENTS

Figure 1:
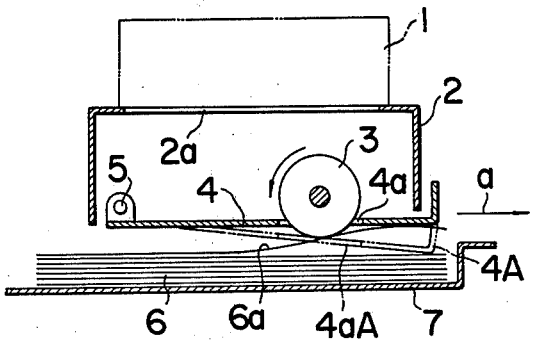
FIG. 1 (PRIOR ART)
FIG. 1 is a sectional side view of the prior art of the invention.
Figure 2:
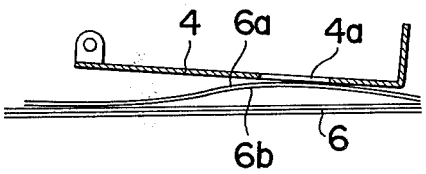
FIG. 2 (PRIOR ART)
FIG. 2 is a view showing the operation of the prior art of FIG. 1.
Figure 3:
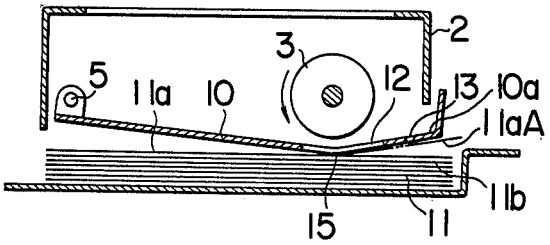
FIG. 3 is a sectional side view of one embodiment of the invention.
Figure 5:
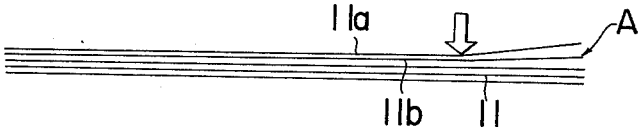
FIG. 5 is a sectional side view showing the principle of operation of the embodiment of FIG. 3.
Figure 6:
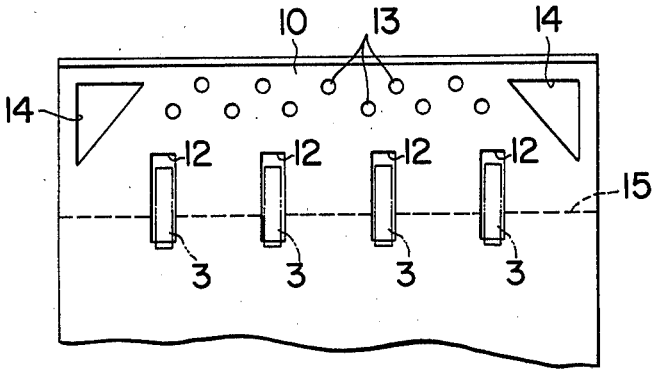
FIG. 6 is a plan view showing the main portion of a vacuum plate of the invention.

Referring to FIG. 3, in suction box 2, vacuum plate 10 is pivotally mounted on support shaft 5. As shown in FIG. 6, the vacuum plate 10 is provided with openings 12, through which paper feed roller 3 extends and by which sheets 11 are sucked; farther suction openings 13; and openings 14, by which both forward corners of the sheet are sucked. The vacuum plate 10 is bent near the center of the openings 12 so that the forward end portion 10*a* of the vacuum plate 10 is positioned away from the sheets 11, and the bent portion constitutes sheet pressing portion 15. When this apparatus is not operated, the sheet pressing portion 15 of the vacuum plate 10 is in pressure contact with the sheets at a position near the forward ends of the sheets. Thus the forward ends of the sheets are lifted somewhat as shown in FIG. 5 since the sheets 11 are pressed by the sheet pressing portion 15, with the result that a slight gap A is formed between the top sheet and the underlying sheet. Thus the sheets are slightly separated from one another at the forward ends thereof before being separated by the sheet feeding apparatus.

Upon a command to feed paper, a vacuum mechanism (not shown) is actuated to evacuate air from the suction box 2. Thereupon the forward end of the top sheet 11*a*, a gap having already been formed between the top sheet and the underlying sheet, is sucked to the openings 12, 13, 14 of the vacuum plate 10 as shown by chain line 11*a*A. Here, the corner portions of the top sheet are initially sucked.

Figure 4:
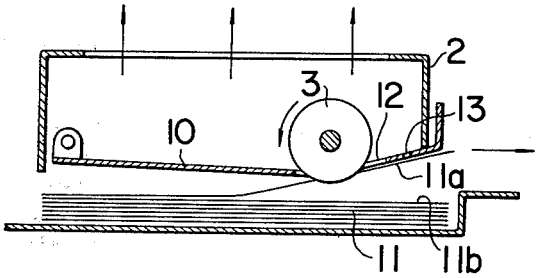
FIG. 4 is a sectional side view showing the operation of the embodiment of FIG. 3.

When all the openings of the vacuum plate 10 are closed by the sheet 11*a*, the vacuum plate 10, sucking the sheet 11*a*, is pivoted by suction and lifted as shown in FIG. 4. Upon the vacuum plate 10 being lifted, the paper feed rollers 3, rotating in the direction of the arrow, extend through the opening 12 and come in contact with the sucked sheet, and the sheet is translated in the direction of the arrow by friction.

In the above-mentioned embodiment having a sheet pressing portion, as the sheets are pressed by the sheet pressing portion 15 before being sucked, gaps are formed in advance between the end portions of the top sheets so that the sheets do not cling together any longer, and only the forward end portion of the top sheet is first sucked to the vacuum plate, so that secure paper separation is accomplished without a plurality of sheets being fed together.

Figure 7:
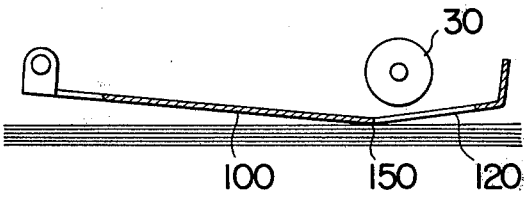
FIG. 7 is a sectional side view of another embodiment of the invention.
Figure 8:
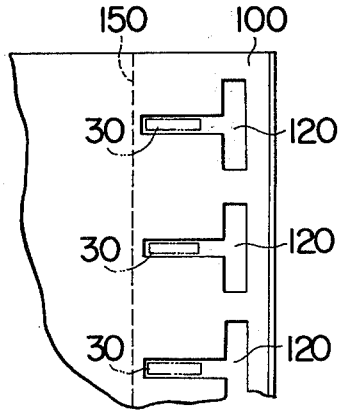
FIG. 8 is fragmentary plan view of another vacuum plate of the present invention.

Another embodiment of the vacuum plate of the invention is shown in FIG. 7, wherein the openings 120 for sucking sheets are formed in positions nearer the forward ends of the sheets than the sheet pressing portion 150, or on the right of the sheet pressing portion as viewed in the figure. In the vacuum plate 100 in the figure, openings through which paper feed roller 30 extends, and sheet suction openings 120 including the openings for sucking the forward ends and corners of the sheet, are formed in positions nearer the forward ends of the sheets than the sheet pressing portion 150. In this embodiment, the paper feed roller 30 is formed as thin as possible and with respect to its diameter, as small as possible, so long as paper feeding can be sufficiently accomplished. The openings for sucking the forward ends and corners of the sheet, and the openings through which the paper feed rollers 30 extend, can be combined in the shape of T as shown in FIG. 8.

In a vacuum plate having the sheet suction openings in the position nearer the forward end of the sheets than the sheet pressing portion, the openings through which the paper feed rollers extend, and the openings for sucking the forward end and corners of the sheet, can also be formed separately as shown in FIG. 6.

Figure 9:
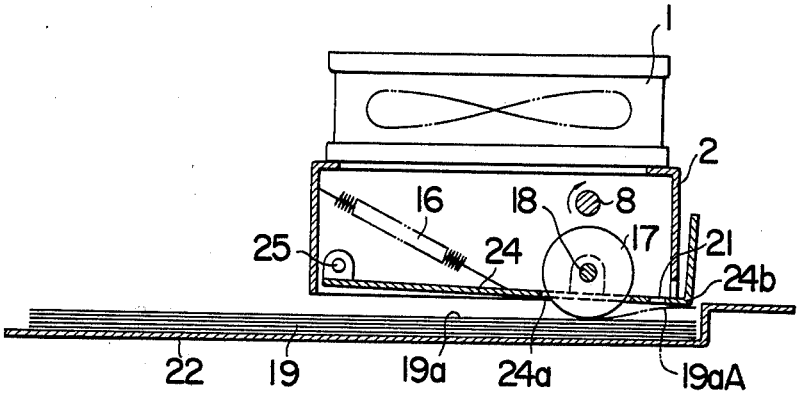
FIG. 9 is a sectional side view of a further embodiment of the invention.
Figure 11:
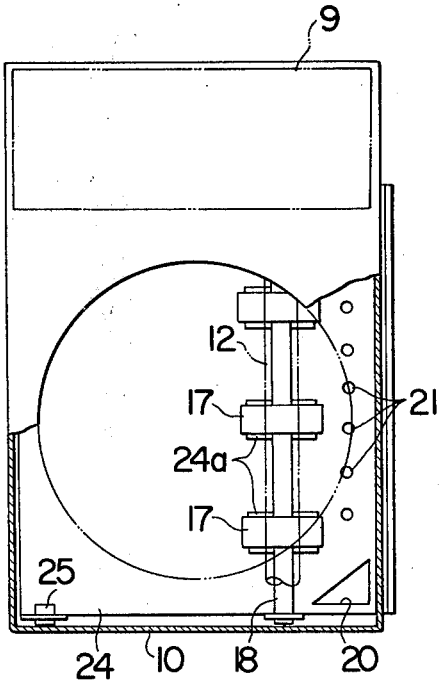
FIG. 11 is a partly fragmentary plan view of the embodiment shown in FIG. 10.

Now referring to FIG. 9, in suction box 2, drive shaft 8 is disposed normal to the sheet feeding direction, which is rotated in the direction of the arrow by driving mechanism 9 (refer to FIG. 11). Axial fan 1 is disposed above the suction box 2.

Vacuum plate 24, forming the bottom of the suction box 2, is pivotally supported by the box 2 on support shaft 25, and relatively weak compression spring 16 is connected between the vacuum plate 24 and the box 2.

Paper feed roller 17 is rotatably mounted on the vacuum plate 24 in a position beneath the drive shaft 8. The paper feed roller 17 is secured to support shaft 18 and part of the peripheral surface of the roller extends downwardly through opening 24*a* formed in the plate 24. In the vacuum plate 24, corner sucking openings 20 (only one is shown) for sucking the two corners of the leading end of a sheet, and leading end sucking openings 21 for sucking the leading end of a sheet are formed, respectively, rightward of the opening 24*a*, or nearer the leading ends of sheets 19 (refer to FIG. 11).

The sheets 19, whose leading ends are aligned vertically, are stacked on sheet receptacle 22.

When the apparatus is not operated, the paper feed roller 17 is in contact with the top sheet 19*a*, while forward end 24*b* of the vacuum plate is spaced apart therefrom, as shown in FIG. 9.

Upon a command to feed paper, the drive shaft 8 begins to rotate in the direction of the arrow and the axial fan 1 is actuated to initiate a sucking operation. By this sucking action, the top sheet 19*a* has its two corners at its leading end sucked through the corner sucking openings 20 (refer to FIG. 11) and has its leading end sucked through the openings 21 because there is a gap between the sheets owing to the pressing action of the paper feed roller 17 on the stack of sheets 19. Thus, the top sheet 19*a* is drawn by suction as indicated by chain line 19*a*A in FIG. 9 and separated from a directly underlying sheet 19*b*. The vacuum plate 24, whose openings 20, 21 are closed by the sheet, then sucks the sheet 19*a* through the opening 24*a* with the paper feed roller 17 extending downwardly therethrough.

Figure 10:
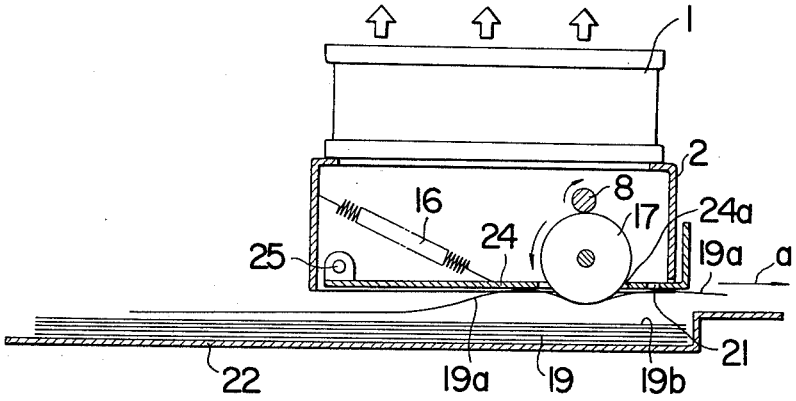
FIG. 10 is a view showing the operation of the embodiment of FIG. 9.

The vacuum plate 24, whose openings 24*a*, 20, 21 have been closed, is pivotally moved upwardly as shown in FIG. 10 by virtue of the sucking action of the axial fan. The upward movement of the vacuum plate 24 brings the paper feed roller 17 into contact with the drive shaft 8, so that the roller 17 is rotated in the direction of the arrow, following the drive shaft 8. By the rotation of the paper feed roller 17 in this manner, the sheet 19*a* in contact with the roller is translated in the direction of arrow a.

As mentioned above, in the paper feeding apparatus by air suction of the invention, the paper feed roller is mounted on the vacuum plate and is caused to rotate by the rotating drive shaft when the plate moves upwardly. In this apparatus, the force of the vacuum plate for sucking a sheet is constant irrespective of the position of the plate. Also, as the sheets are pressed by the feed roller, a gap is formed between the leading end portions of the adjacent sheets, and suction is first applied to the leading end portion including the two corners thereof, so that the sheets can be separated securely from one another.

Furthermore, since part of the paper feed roller extends through the vacuum plate, the feed action of the roller can be positively transmitted to the sucked sheet. In the illustrated embodiment, an axial fan is located above the suction box to perform a sucking operation. It is to be understood that the invention is not limited to this, and that air suction means mounted elsewhere may be used by connecting with the suction box through a pipe or a shutter. The vacuum plate may be moved vertically while disposed in a horizontal position by means of a suspension mechanism including a link mechanism or a spring, instead of being moved pivotally.

The use of such suspension mechanism eliminates variations in the gap between the leading end portions of the sheets which might otherwise occur when there are changes in the quantity of sheets, thereby offering the advantage of making it possible to effect separation and feeding of paper more positively and stably.

Figure 12:
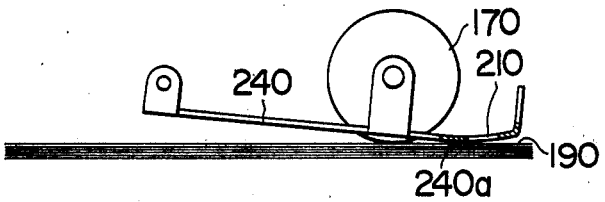
FIG. 12 is a side view showing essential portions of a further embodiment of the invention.

As shown in FIG. 12, the projecting portion of paper feed roller 170 through vacuum plate 240 is preferably minimized. If the projection is small, then the gap between forward end portion 240*a* of the plate 240 and the sheet 190 becomes small and the sheet responds so quickly to the suction force exerted through openings 210 that it is positively sucked into contact with the roller. In this case, the forward end portion of the plate is bent so that the forward end of the plate may not press the sheets.

What is claimed is:

1. In an apparatus for feeding sheets individually from a stack thereof, comprising a suction box adapted to lie over said stack and having a bottom plate having at least one aperture therein, said bottom plate being movable upwardly between a first position adjacent to the uppermost sheet in said stack and a second position lifting from said stack any of said sheets held to said bottom plate by low pressure acting through said at least one aperture in said plate, and at least one roller mounted within said box and each said roller having a portion thereof adapted to extend through a respective aperture for contacting the uppermost of said raised sheets and feeding it forwardly from under said box, the improvement comprising means carried by said bottom plate and adapted to press said stack of sheets at a location spaced rearwardly from the forward end portion thereof for raising the forward end portion of said uppermost sheet for separating it from said stack to attract it to said plate.

2. An apparatus according to claim 1, said raising means being comprised by a bend formed in a forward portion of said bottom plate.

3. An apparatus according to claim 1, said raising means being comprised by said at least one roller.

4. An apparatus according to claim 3, further comprising means located above each said roller for rotating it in its raised position.

5. An apparatus according to claim 1, each said at least one roller extending through a respective aperture spaced rearwardly from the forward end of said bottom plate, and the portion of said bottom plate extending forwardly of said at least one roller angling upwardly.

6. An apparatus according to claim 1, including a plurality of said rollers.

7. In an apparatus for feeding sheets individually from a stack thereof, comprising a suction box adapted to lie over said stack and having a bottom plate having at least one aperture therein, said bottom plate being movable upwardly between a first position adjacent the uppermost sheet in said stack and a second position raising from said stack any of said sheets held to said bottom plate by low pressure acting through said at least one aperture in said plate, and at least one roller mounted within said box and each said roller having a portion thereof adapted to extend through a respective aperture for contacting the uppermost of said raised sheets and feeding it forwardly from under said box, the improvement comprising each said roller being carried by said bottom plate at a location spaced rearwardly from the forward end portion of said stack of sheets and pressing said forward end portion when said bottom plate is in said first position for raising the forward end portion of said uppermost sheet and separating it from said stack to attract it to said bottom plate.

8. An apparatus according to claim 7, further comprising means located above each said roller for rotating it in its raised position.

9. An apparatus according to either of claims 3, 7 or 8, said bottom plate being connected to a spring urging said bottom plate upwardly.

* * * * *